US008290406B2

(12) United States Patent
Suzuki

(10) Patent No.: US 8,290,406 B2
(45) Date of Patent: Oct. 16, 2012

(54) POWDER CONVEYING DEVICE AND IMAGE FORMING APPARATUS

(75) Inventor: Toshiaki Suzuki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 556 days.

(21) Appl. No.: 12/543,937

(22) Filed: Aug. 19, 2009

(65) Prior Publication Data

US 2010/0172674 A1 Jul. 8, 2010

(30) Foreign Application Priority Data

Jan. 5, 2009 (JP) ..... 2009-000143

(51) Int. Cl.
*G03G 15/08* (2006.01)

(52) U.S. Cl. ..... 399/258; 399/256

(58) Field of Classification Search ..... 399/258, 399/255, 256, 260, 263
See application file for complete search history.

(56) References Cited

U.S. PATENT DOCUMENTS

| | | | | |
|---|---|---|---|---|
| 4,894,688 | A | 1/1990 | Taniguchi et al. | 355/298 |
| 5,572,299 | A * | 11/1996 | Kato et al. | 399/256 |
| 6,366,755 | B1 | 4/2002 | Takashima | 399/254 |
| 2004/0265011 | A1 | 12/2004 | Tsuda et al. | |
| 2005/0013633 | A1* | 1/2005 | Harumoto | 399/258 |
| 2007/0231015 | A1 | 10/2007 | Sakamaki | |
| 2008/0056772 | A1 | 3/2008 | Utsumi et al. | 399/254 |
| 2008/0199225 | A1* | 8/2008 | Makino | 399/258 |
| 2008/0260431 | A1* | 10/2008 | Saito | 399/256 |
| 2009/0028599 | A1* | 1/2009 | Jun | 399/103 |

FOREIGN PATENT DOCUMENTS

| | | |
|---|---|---|
| JP | 63-214783 | 9/1988 |
| JP | 03-180876 | 8/1991 |
| JP | 05-224530 | 9/1993 |
| JP | 05-303281 | 11/1993 |
| JP | 10-078696 | 3/1998 |
| JP | 11-044990 | 2/1999 |
| JP | 2001-296731 | 10/2001 |
| JP | 2004-126326 | 4/2004 |
| JP | 2005-24665 | 1/2005 |
| JP | 2006058667 | 3/2006 |
| JP | 2007264511 | 10/2007 |
| JP | 2008-058339 | 3/2008 |

OTHER PUBLICATIONS

JP Office Action dated Jun. 28, 2011, from corresponding Japanese patent application 2009-000143.

* cited by examiner

*Primary Examiner* — Walter L Lindsay, Jr.
*Assistant Examiner* — Rodney Bonnette
(74) *Attorney, Agent, or Firm* — Morgan, Lewis & Bockius LLP

(57) ABSTRACT

An aspect of the invention is a powder conveying device including a conveying passage where powder is conveyed from a first powder accommodating chamber toward a second powder accommodating chamber, in the conveying passage, a conveying member including a rotating shaft rotatable, and a blade member spirally provided around the rotating shaft and enable to convey the powder by rotation of the rotating shaft, an intake region including an intake port through which the powder is taken in from the first powder accommodating chamber, a first conveying region arranged on a downstream side of the intake region in a conveying direction of the powder, and a second conveying region arranged on a downstream side of the first conveying region in the conveying direction, a conveyable volume of the powder per one revolution of the conveying member at the second conveying region being lower than that at the first conveying region.

12 Claims, 12 Drawing Sheets

POWDER CONVEYING DEVICE AND IMAGE FORMING APPARATUS

CROSS-REFERENCE TO RELATED APPLICATION

This application is based on and claims priority under 35 USC 119 from Japanese Patent Application No. 2009-000143 filed Jan. 5, 2009.

BACKGROUND

Technical Field

The present invention relates to a powder conveying device and an image forming apparatus.

SUMMARY

In accordance with an aspect of the invention, a powder conveying device includes: a conveying passage in which powder is conveyed from a first powder accommodating chamber toward a second powder accommodating chamber, the powder being accommodated in the first powder accommodating chamber and the second powder chamber; a conveying member that is disposed in the conveying passage, and includes a rotating shaft that is rotatable, and a blade member that is spirally provided around the rotating shaft, and can convey the powder by rotation of the rotating shaft; an intake region that is formed on the conveying passage where the conveying member is disposed, and includes an intake port through which the powder is taken in from the first powder accommodating chamber; a first conveying region that is formed on the conveying passage where the conveying member is disposed, and is arranged on a downstream side of the intake region in a conveying direction of the powder; and a second conveying region that is formed on the conveying passage where the conveying member is disposed, and is arranged on a downstream side of the first conveying region in the conveying direction, a conveyable volume of the powder per one revolution of the conveying member at the second conveying region being lower than that at the first conveying region.

BRIEF DESCRIPTION OF THE DRAWINGS

Exemplary embodiments of the invention will be described in detail with reference to the following figures, wherein.

DETAILED DESCRIPTION

An exemplary embodiment of the present invention will be described below with reference to the drawings.

Figure 1:
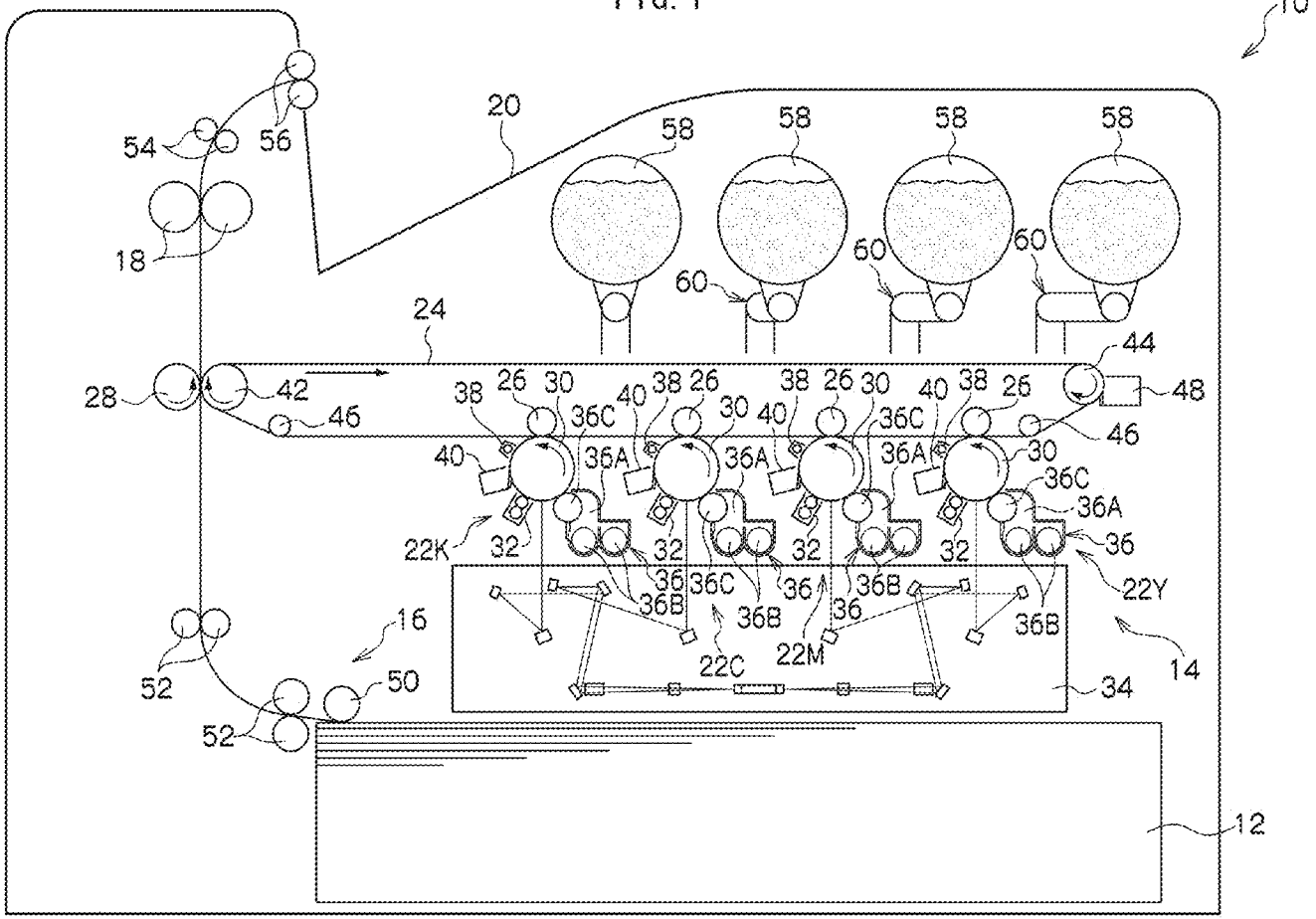
FIG. 1 is a schematic diagram illustrating an entire configuration of an image forming apparatus according to an exemplary embodiment of the invention.

Entire Configuration of Image Forming Apparatus according to an Exemplary Embodiment An entire configuration of an image forming apparatus according to an exemplary embodiment of the invention will be described. FIG. 1 is a schematic diagram illustrating the entire configuration of the image forming apparatus of the exemplary embodiment.

An image forming apparatus 10 includes a recording medium accommodating unit 12, an image forming section 14, a transporting unit 16, a fixing device 18, and a recording medium discharge unit 20. A recording medium P such as a sheet is accommodated in the recording medium accommodating unit 12. The image forming section 14 forms a toner image in the recording medium P. The transporting unit 16 transports the recording medium P from the recording medium accommodating unit 12 to the image forming section 14. The fixing device 18 fixes the toner image formed by the image forming section 14 to the recording medium P. The recording medium P to which the toner image is fixed by the fixing device 18 is discharged at the recording medium discharge unit 20.

The image forming section 14 includes image forming units 22Y, 22M, 22C, and 22K, a intermediate transfer belt 24, a first transfer roller 26, and a second transfer roller 28. The image forming units 22Y, 22M, 22C, and 22K form yellow (Y), magenta (M), cyan (C), and black (K) toner images, respectively. The toner images formed by the image forming units 22Y, 22M, 22C, and 22K are transferred to the intermediate transfer belt 24 that is an example of an intermediate transfer member. The first transfer roller 26 that is an example of a first transfer member transfers the toner images formed by the image forming units 22Y, 22M, 22C, and 22K to the intermediate transfer belt 24. The second transfer roller 28 that is an example of a secondary transfer member transfers the toner images, transferred to the intermediate transfer belt 24, to the recording medium P.

Each of the image forming units 22Y, 22M, 22C, and 22K includes a photosensitive drum 30 rotated in one direction (counterclockwise in FIG. 1). The photosensitive drum 30 is an image carrier in which an electrostatic latent image is formed in a surface thereof.

A charging device 32, an exposure device 34, a development device 36, an eraser device 38, and a toner removing device 40 are provided around each photosensitive drum 30 in that order from the upstream side in the rotating direction of the photosensitive drum 30. The charging device 32 charges the surface of the photosensitive drum 30. The exposure device 34 exposes the surface of the charged photosensitive drum 30 to form an electrostatic latent image in the surface of the photosensitive drum 30. The development device 36 develops the electrostatic latent image formed in the surface of the photosensitive drum 30, thereby forming a toner image. The eraser device 38 erases charge from the surface of the photosensitive drum 30 after the toner image is transferred to the intermediate transfer belt 24. The toner removing device 40 removes toner remaining on the surface of the photosensitive drum 30 after the toner image is transferred to the intermediate transfer belt 24.

Toner accommodating chambers 58 are provided above the intermediate transfer belt 24, and the toner accommodating chamber 58 is an example of a first powder accommodating chamber in which the toner is stored (accommodated). The toner accommodating chambers 58 are provided in the image forming units 22Y, 22M, 22C, and 22K, respectively. The toner is supplied from the toner accommodating chamber 58 to the development device 36 of each of the image forming units 22Y, 22M, 22C, and 22K.

The development device 36 includes a development chamber 36A in which a developer including the toner and a magnetic carrier is accommodated, and the development chamber 36A is an example of a second powder chamber in which the powder is accommodated. A conveying member 36B and a development roller 36C are provided in the development chamber 36A. The conveying member 36B conveys the developer while stirring the developer. The development roller 36C that is an example of a developer retaining member retains the developer conveyed by the conveying member 36B. The toner retained by the development roller 36C adheres to the surface of the photosensitive drum 30 to develop the electrostatic latent image.

A toner conveying device 60 is provided between the toner accommodating chamber 58 and the development chamber 36A. The toner conveying device 60 is as a powder conveying device that conveys the powder, and the toner conveying device 60 conveys the toner from the toner accommodating chamber 58 toward the development chamber 36A. A configuration of the toner conveying device 60 is described later.

The toner conveying device 60 of the exemplary embodiment may be used to a case in which powder except for the toner is conveyed. For example, the toner conveying device 60 may be used to powder except for the toner whose fluidity is changed by a change in environmental conditions or production conditions.

The intermediate transfer belt 24 is entrained about a facing roller 42, and a driving roller 44, and a support roller 46. The facing roller 42 faces the second transfer roller 28. The intermediate transfer belt 24 is circularly moved in one direction (clockwise in FIG. 1) while being in contact with the photosensitive drums 30.

A toner removing unit 48 is provided on the intermediate transfer belt 24 in order to remove the toner remaining on the intermediate transfer belt 24.

The first transfer roller 26 faces the photosensitive drum 30 so as to sandwich the intermediate transfer belt 24 with the photosensitive drum 30. A first transfer position is formed between the first transfer roller 26 and the photosensitive drum 30. The toner image on the photosensitive drum 30 is first-transferred to the intermediate transfer belt 24 in the first transfer position. In the first transfer position, the first transfer roller 26 transfers the toner image on the surface of the photosensitive drum 30 to the intermediate transfer belt 24 by a pressing force and an electrostatic force.

The second transfer roller 28 faces the facing roller 42 so as to sandwich the intermediate transfer belt 24 with the facing roller 42. A second transfer position is formed between the second transfer roller 28 and the facing roller 42. The toner image on the intermediate transfer belt 24 is second-transferred to the recording medium P in the second transfer position.

The transporting unit 16 includes a delivery roller 50 and pairs of transporting rollers 52. The delivery roller 50 delivers the recording medium P accommodated in the recording medium accommodating unit 12. The pair of transporting rollers 52 transports the recording medium P delivered by the delivery roller 50 to the second transfer position while sandwich the recording medium P therebetween.

The fixing device 18 is disposed on the downstream side of the second transfer position in the transporting direction to fix the toner image which is transferred in the second transfer position to the recording medium P.

A pair of transporting rollers 54 and a pair of discharge rollers 56 are disposed in this order on the downstream side of the fixing device 18 in the transporting direction. The pair of transporting rollers 54 transports the recording medium P while sandwiching the recording medium P therebetween. The pair of discharge rollers 56 discharges the recording medium P to the recording medium discharge unit 20.

An image forming operation forming an image in the image forming apparatus of the exemplary embodiment will be described below.

In the image forming apparatus 10 of the exemplary embodiment, when the image is formed in the recording medium P, the pair of transporting rollers 52 transports the recording medium P delivered from the recording medium accommodating unit 12 to the second transfer position.

On the other hand, in the intermediate transfer belt 24, the toner images formed by the image forming units 22Y, 22M, 22C, and 22K are superposed to form the color image. The color image formed on the intermediate transfer belt 24 is transferred to the recording medium P transported to the second transfer position.

The recording medium P to which the toner image is transferred is transported to the fixing device 18, and the transferred toner image is fixed by the fixing device 18. The pair of discharge rollers 56 discharges the recording medium P to which the toner image is fixed to the recording medium discharge unit 20. In this manner, the series of image forming operation is performed.

Configuration of Toner Conveying Device according to an Exemplary Embodiment

Figure 2:
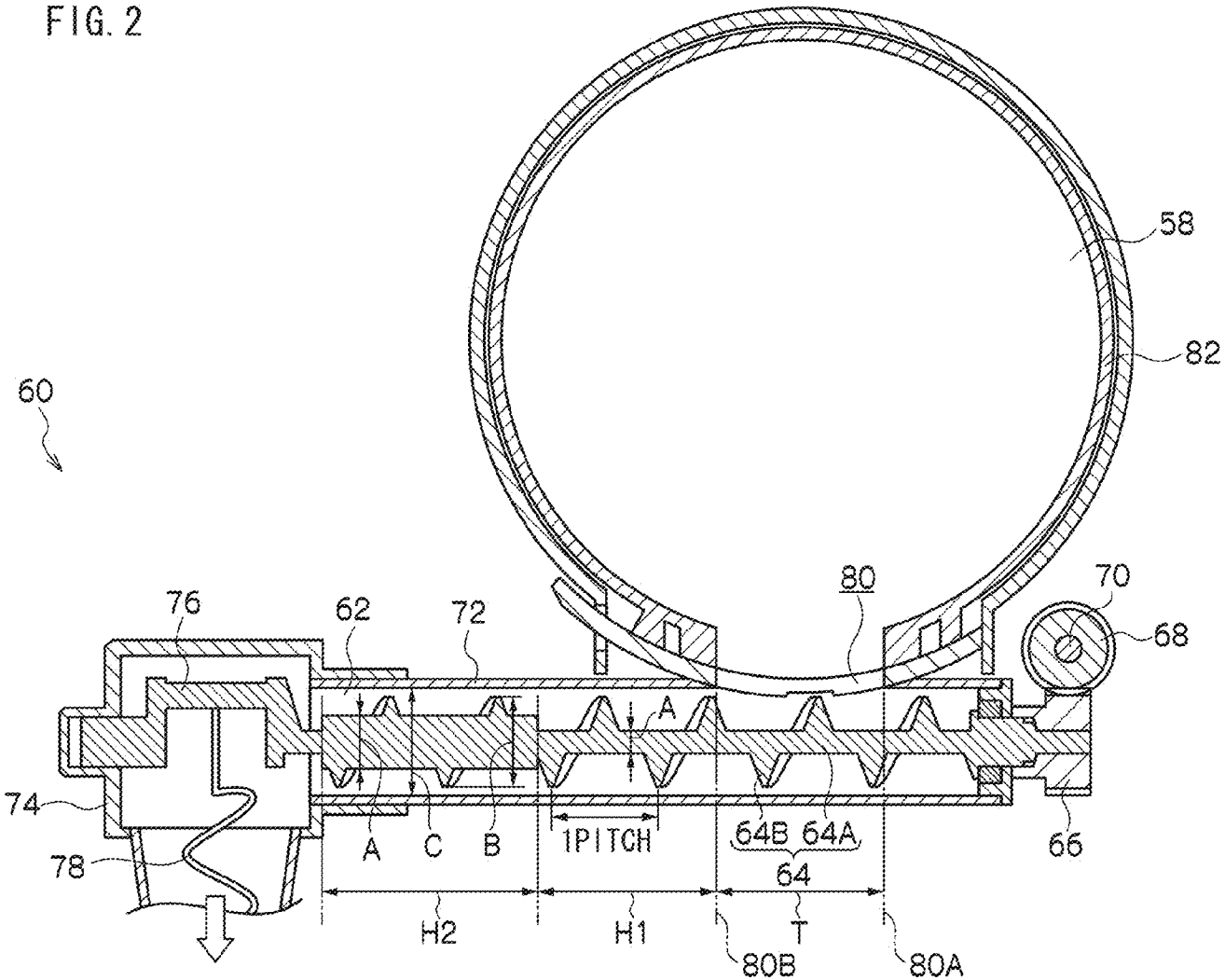
FIG. 2 is a schematic diagram illustrating a configuration of a toner conveying device of the exemplary embodiment (Example 1)

A configuration of the toner conveying device of the exemplary embodiment will be described below. FIG. 2 is a schematic diagram illustrating the configuration of the toner conveying device of the exemplary embodiment.

The toner conveying device 60 of the exemplary embodiment includes a conveying passage 62 and a conveying member 64. The toner is conveyed from the toner accommodating chamber 58 toward the development chamber 36A through the conveying passage 62. The conveying member 64 is disposed in the conveying passage 62 to convey the toner.

The toner accommodating chamber 58 is formed in a toner storage container 82 in which the toner is accommodated. For example, the toner storage container 82 is structured by a toner cartridge. The toner is accommodated in the toner cartridge that is detachably attached into the image forming apparatus 10.

The conveying passage 62 is formed by the inside of a conveying pipe 72 and the inside of a conveying pipe 74. The conveying pipe 72 is horizontally extended. The conveying pipe 74 is coupled to one end of the conveying pipe 72, and the conveying pipe 74 is vertically extended. The conveying member 64 is disposed in the conveying pipe 72.

The conveying member 64 is formed into a conveying screw, and the conveying member 64 includes a rotating shaft 64A and a blade member 64B. The blade member 64B is spirally provided around the rotating shaft 64A, and the blade member 64B can convey the toner by the rotation of the rotating shaft 64A.

A gear portion 66 is provided at one end (right end in FIG. 2) of the rotating shaft 64A. The gear portion 66 is meshed with a gear portion 68 provided in a driving shaft 70 of a driving portion (not illustrated). Therefore, the driving shaft 70 is rotated by a driving force of the driving portion, and the torque of the driving shaft 70 is transmitted to the rotating shaft 64A through the gear portions 68 and 66. The rotating shaft 64A to which the torque of the driving shaft 70 is transmitted is rotated to convey the toner by the blade member 64B.

A crank 76 is coupled to the other end of the rotating shaft 64A to convert rotational motion of the rotating shaft 64A into reciprocating motion. One end of a spiral wound coil 78 is coupled to the crank 76. Therefore, the crank 76 converts the rotational motion of the rotating shaft 64A into the reciprocating motion to vertically move the coil 78.

In the conveying pipe 72, an intake region T having an intake port 80 is formed on the conveying passage 62 where the conveying member 64 is disposed. The toner is taken in the conveying pipe 72 from the toner accommodating chamber 58 through the intake port 80. The intake port 80 is formed below the toner accommodating chamber 58 and at an upper portion of the conveying pipe 72. The toner falling from the toner accommodating chamber 58 is taken in the conveying passage 62 in the conveying pipe 72 through the intake port 80.

In the intake region T, the conveying member 64 conveys the toner taken in through the intake port 80 to the downstream side. The intake region T ranges from one end (a portion of a chain double-dashed line 80A) of the intake port 80 to the other end (a portion of a chain double-dashed line 80B).

In the conveying pipe 72, a first conveying region H1 is formed on the conveying passage 62 where the conveying member 64 is disposed. The first conveying region H1 is disposed on the downstream side of the intake region T in the conveying direction. In the first conveying region H1, the conveying member 64 conveys the toner conveyed from the intake region T to the downstream side.

In the conveying pipe 72, a second conveying region H2 is formed on the conveying passage 62 where the conveying member 64 is disposed. The second conveying region H2 is disposed on the downstream side of the first conveying region H1 in the conveying direction. In the second conveying region H2, the conveying member 64 conveys the toner conveyed from the first conveying region H1 to the downstream side.

In the second conveying region H2, a conveyable volume per one revolution of the conveying member 64 is lower than that of the first conveying region H1. Specifically, in the second conveying region H2, a diameter (shaft diameter) of the rotating shaft 64A of the conveying member 64 is larger than that of the first conveying region H1.

For example, the diameter of the rotating shaft 64A ranges is equal to or more than 8 mm and equal to or less than 9 mm in the second conveying region H2 in a case where the rotating shaft 64A has the diameter of 3 mm in the intake region T and first conveying region H1.

In this case, an outer diameter of the blade member 64B is set to 12 mm, an inner diameter of the conveying pipe 72 (passage width of conveying passage 62) is set to 14 mm, and one pitch of blade member 64B is set to 14 mm. Note that this "one pitch" means a distance from one vertex of the blade member 64B to another vertex of the blade member 64B, which is adjacent to the one vertex in an axial direction of the rotating shaft 64A.

For example, the second conveying region H2 has a length ranging equal to or more than one pitch and equal to or less than two pitches (1-2 pitches) of the blade member 64B, the first conveying region H1 has a length ranging equal to or more than a half pitch and equal to or more than one and a half pitch (0.5-1.5 pitch) of the blade member 64B, and the intake region T has a length of one and a half pitch (1.5 pitch) of the blade member 64B.

In the drawings, the letter A designates a diameter of the rotating shaft 64A, the letter B designates an outer diameter of the blade member 64B, and the letter C designates an inner diameter of the conveying pipe 72.

Figure 4:
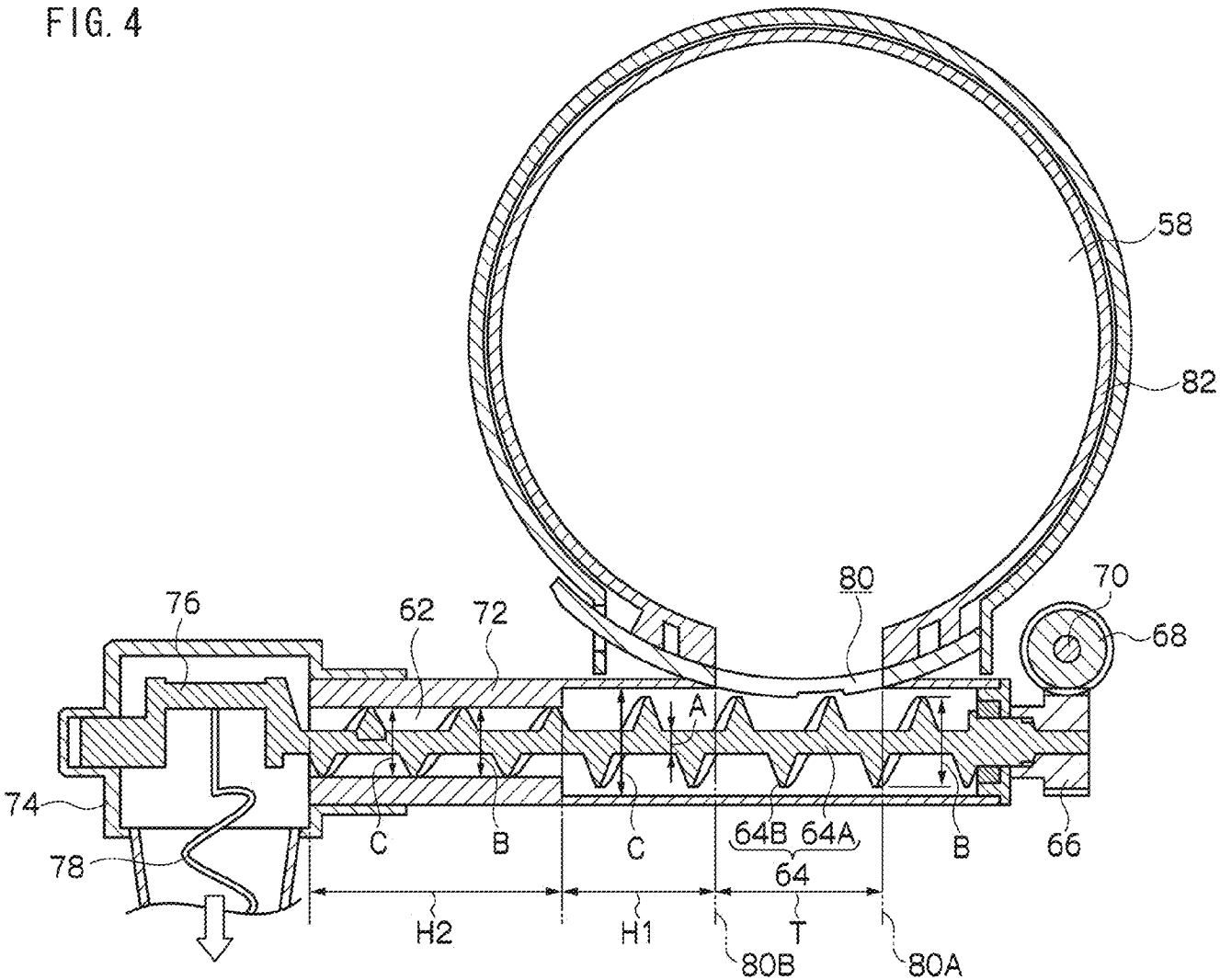
FIG. 4 is a schematic diagram illustrating a configuration of a toner conveying device according to a modification (Example 2) of the exemplary embodiment.

In the second conveying region H2, the configuration in which the conveyable volume per one revolution of the conveying member 64 is lower than that of the first conveying region H1 is not limited to the configuration in which the diameter of the rotating shaft 64A of the conveying member 64 in the second conveying region H2 is larger than that of the first conveying region H1. For example, as illustrated in FIG. 4, in the second conveying region H2, the outer diameter of the blade member 64B of the conveying member 64 may be smaller than that of the first conveying region H1, and the inner diameter of the conveying pipe 72 (the passage width of conveying passage 62) is smaller than that of the first conveying region H1.

At this case, when the outer diameter of the blade member 64B of the conveying member 64 in the first conveying region H1 differs from that in the second conveying region H2, the first conveying region H1 may be equal to the second conveying region H2 in the inner diameter of the conveying pipe 72 (the passage width of conveying passage 62).

In the second conveying region H2, the configuration in which the conveyable volume per one revolution of the conveying member 64 is lower than that of the first conveying region H1 may be a configuration in which the diameter of the rotating shaft 64A of the conveying member 64 in the second conveying region H2 is larger than that of the first conveying region H1, and the outer diameter of the blade member 64B of the conveying member 64 in the second conveying region H2 is smaller than that of first conveying region H1.

Figure 12:
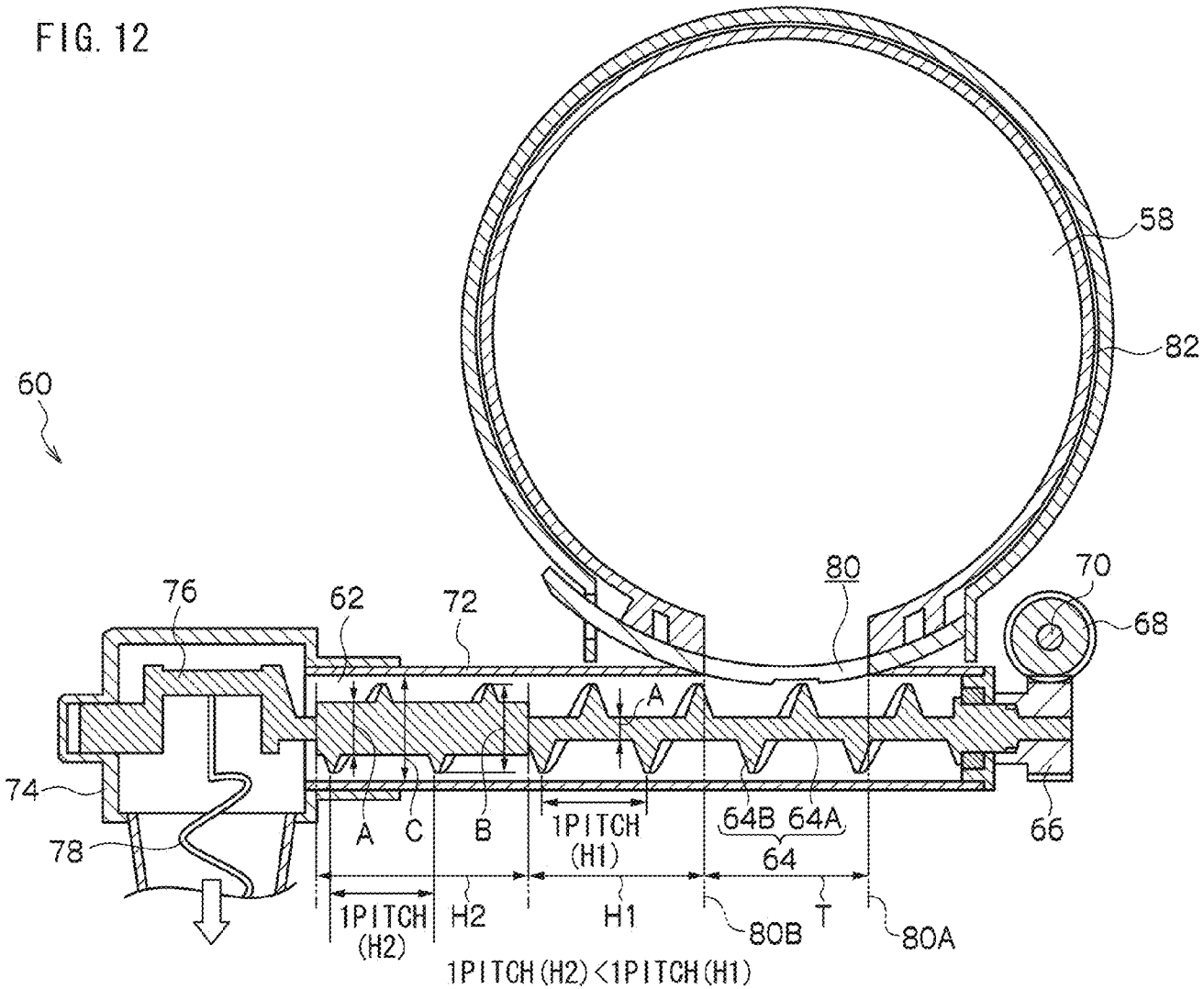
FIG. 12 is a schematic diagram illustrating a configuration of a toner conveying device according to a modification of the exemplary embodiment.

In the second conveying region H2, the configuration in which the conveyable volume per one revolution of the conveying member 64 is lower than that of the first conveying region H1 may be a configuration in which the one pitch of the blade member 64B of the conveying member 64 in the second conveying region H2 is smaller than that of the first conveying region H1. ("1 pitch (H2)" is smaller than "1 pitch (H1)", see FIG. 12)

Note that, as the configuration in which the conveyable volume per one revolution of the conveying member 64 of the second conveying region H2 is lower than that of the first conveying region H1, any of the above mentioned configurations of "the diameter of the rotating shaft 64A of the conveying member 64 in the second conveying region H2 is larger than that of the first conveying region H1", "the outer diameter of the blade member 64B of the conveying member 64 in the second conveying region H2 is smaller than that of the first conveying region H1", "the inner diameter of the conveying pipe 72 (the passage width of conveying passage 62) in the second conveying region H2 is smaller than that of the first conveying region H1", and "one pitch of the blade member 64B of the conveying member 64 in the second conveying region H2 is smaller than that of the first conveying region H1" may be combined.

EVALUATION

Evaluation performed to Examples 1 and 2 and Comparative Examples 1 to 3 will be described below. In the evaluation, in the configuration of the exemplary embodiment, one pitch of the blade member 64B is set to 14 mm, the length of the intake region T is set to one and a half pitches of the blade member 64B, the length of the first conveying region H1 is set to one and a half pitches of the blade member 64B, and the length of the second conveying region H2 is set to two pitches of the blade member 64B.

The evaluation is performed while the diameter of the rotating shaft 64A, the outer diameter of the blade member 64B, and the inner diameter of the conveying pipe 72 are set in each of Examples 1 and 2 and Comparative Examples 1 to 3.

The evaluation is performed by computing a toner conveying amount (dispense rate) per unit time of one toner cartridge using the toner to which a thermal stress is applied by keeping in a high-temperature environment and the toner to which no thermal stress is applied.

Example 1

For Example 1, in the intake region T, the first conveying region H1, and the second conveying region H2, the inner diameter of the conveying pipe 72 is set to 14 mm and the outer diameter of the blade member 64B is set to 12 mm. In the intake region T and the first conveying region H1, the diameter of the rotating shaft 64A is set to 3 mm. In the second conveying region H2, the diameter of the rotating shaft 64A is set to 9 mm (see FIG. 2).

Figure 3:
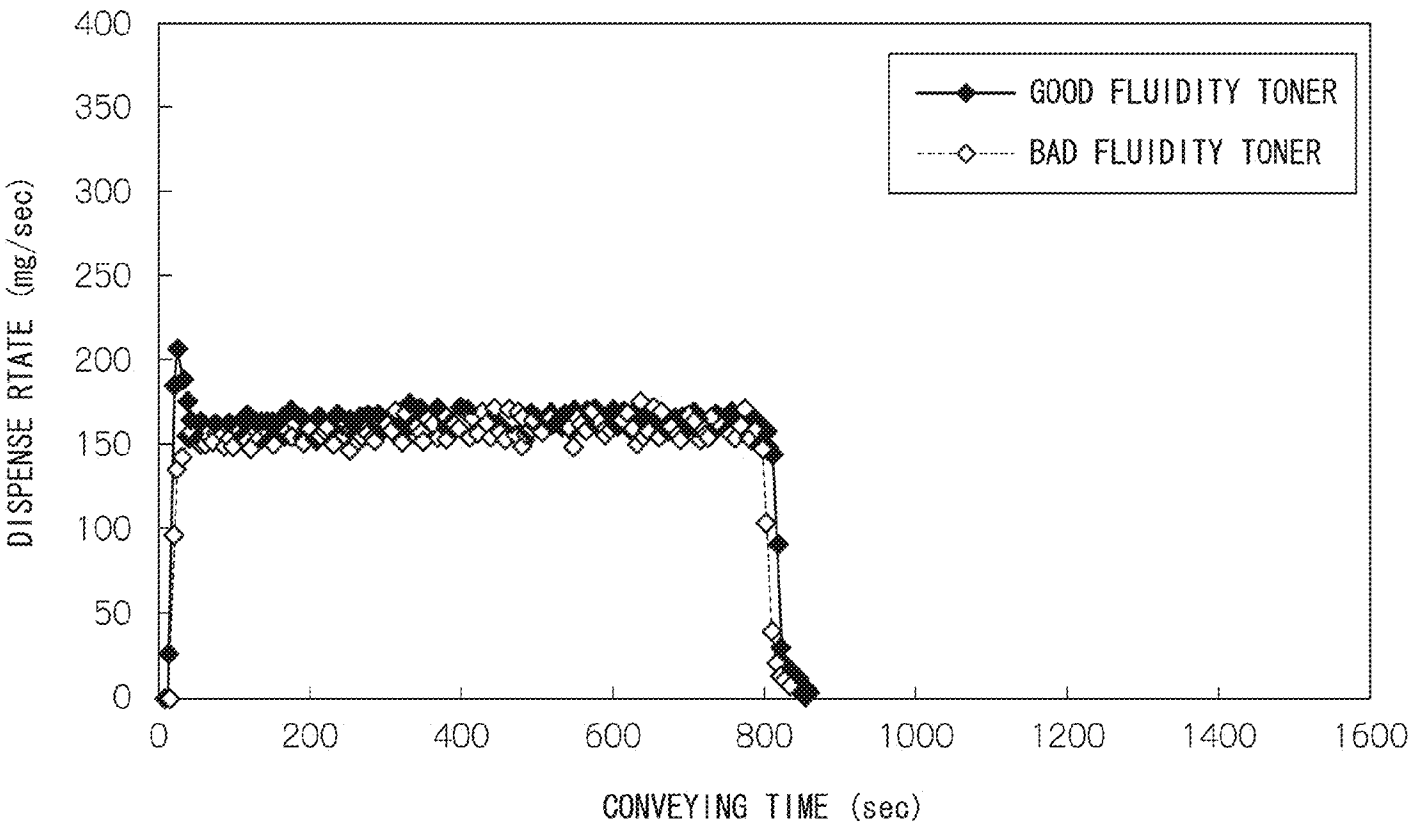
FIG. 3 is a graph illustrating a transition of a dispense rate in Example 1.

As a result of evaluation of Example 1, a difference in dispense rate between the toner to which the thermal stress is applied and the toner to which no thermal stress is applied is 3% as illustrated in FIG. 3.

Although the absolute value of the dispense rate is lowered, the absolute value of the dispense rate may be increased by enhancing the rotating speed for rotating and driving of the rotating shaft 64A as needed or by enlarging the outer diameter of the blade member 64B of the conveying member 64.

Example 2

Figure 5:
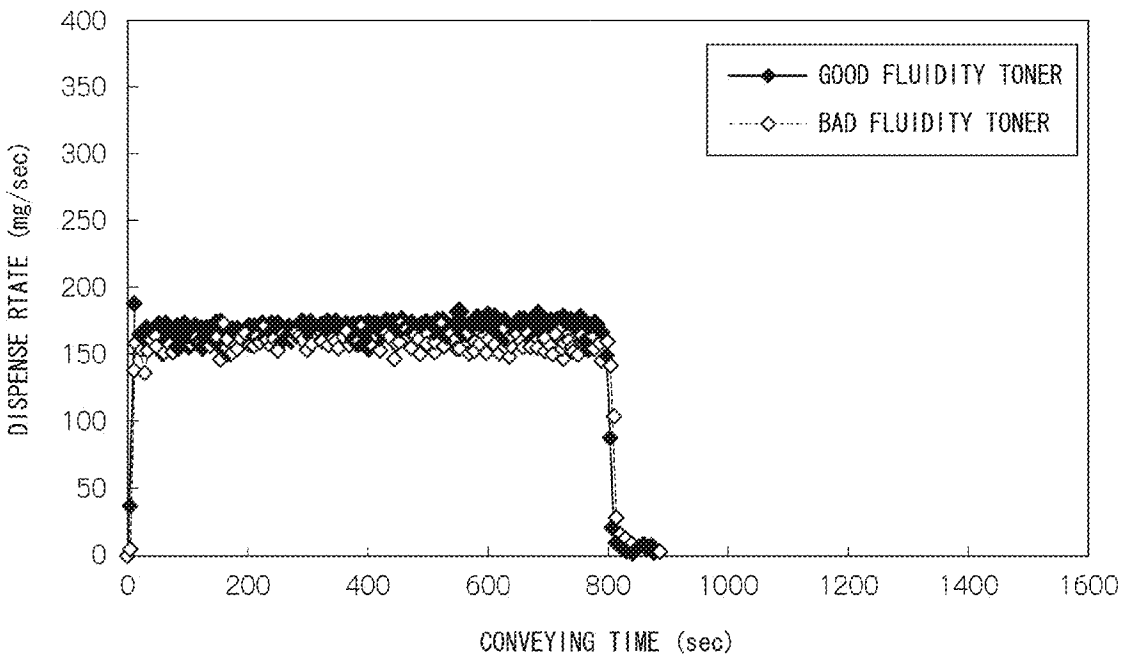
FIG. 5 is a graph illustrating a transition of the dispense rate in Example 2.

For Example 2, the diameter of the rotating shaft 64A is set to 3 mm in the intake region T, the first conveying region H1, and the second conveying region H2. In the intake region T and the first conveying region H1, the inner diameter of the conveying pipe 72 is set to 14 mm and the outer diameter of the blade member 64B is set to 12 mm. In the second conveying region H2, the inner diameter of the conveying pipe 72 is set to 9.5 mm and the outer diameter of the blade member 64B is set to 8.5 mm (see FIG. 4). As a result of evaluation of Example 2, the difference in dispense rate between the toner to which the thermal stress is applied and the toner to which no thermal stress is applied is 7% as illustrated in FIG. 5.

Comparative Example 1

Figure 6:
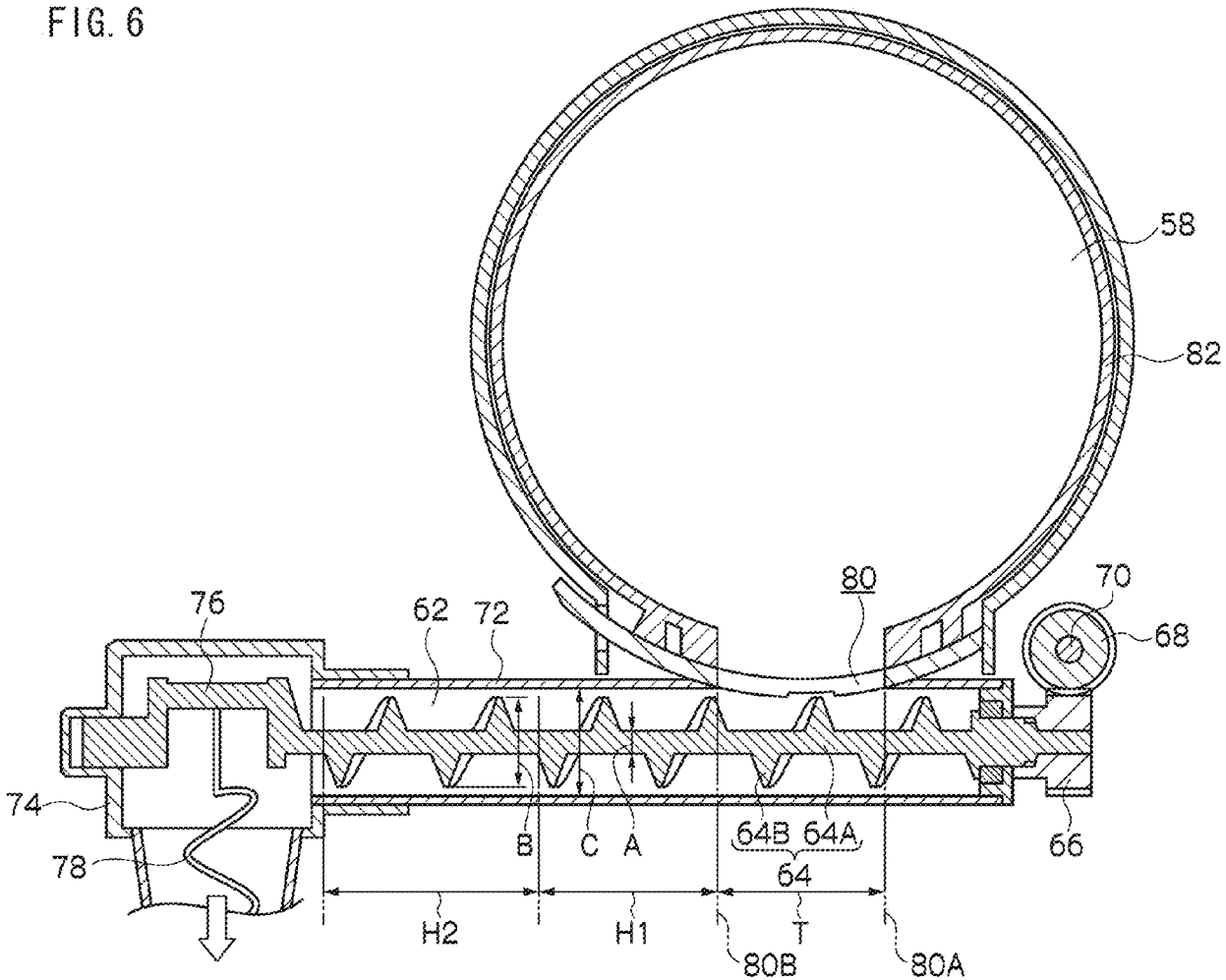
FIG. 6 is a schematic diagram illustrating a configuration of a toner conveying device according to Comparative Example 1.

For Comparative Example 1, in the intake region T, the first conveying region H1, and the second conveying region H2, the inner diameter of the conveying pipe 72 is set to 14 mm, the outer diameter of the blade member 64B is set to 12 mm, and the diameter of the rotating shaft 64A is set to 3 mm (see FIG. 6).

Figure 7:
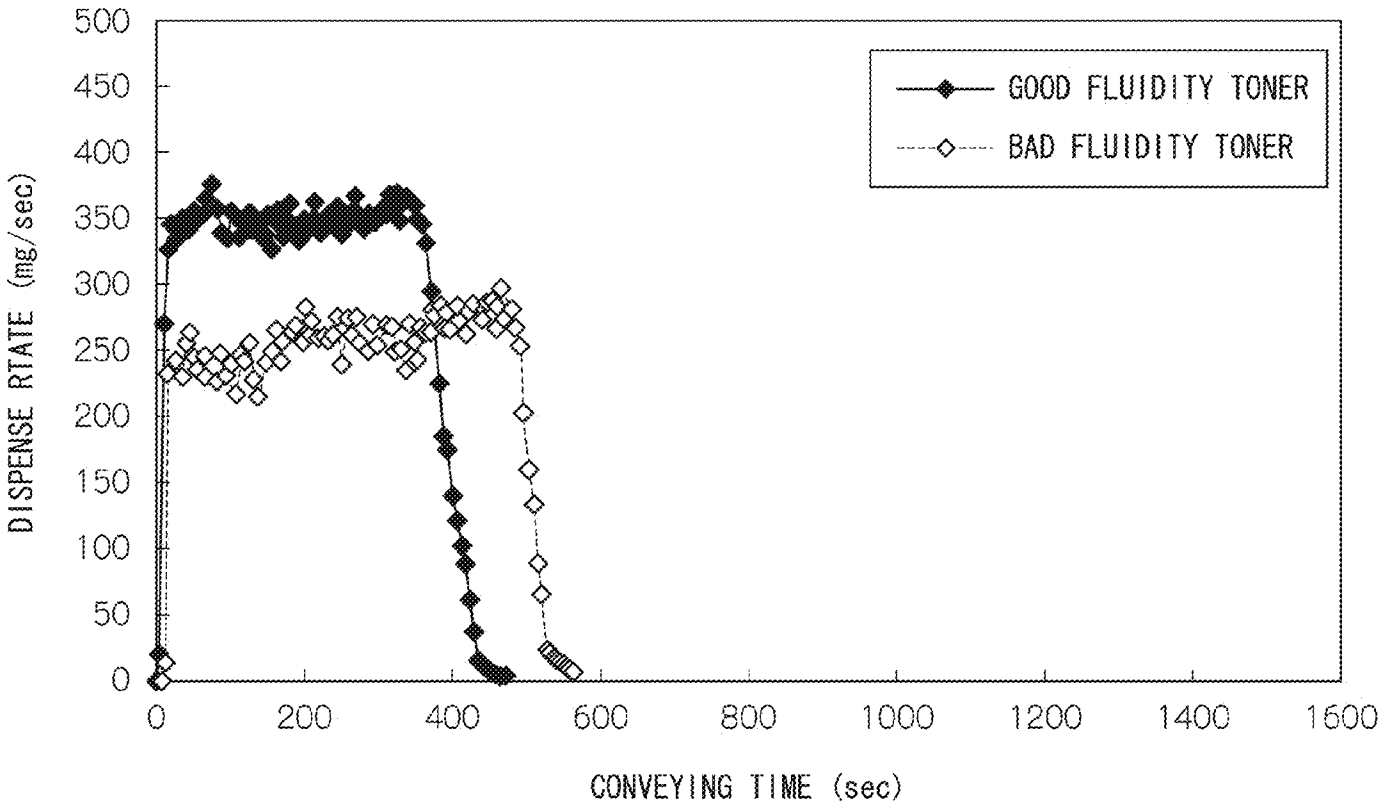
FIG. 7 is a graph illustrating a transition of the dispense rate in Comparative Example 1.

As a result of evaluation of Comparative Example 1, the difference in dispense rate between the toner to which the thermal stress is applied and the toner to which no thermal stress is applied is 25% as illustrated in FIG. 7.

Comparative Example 2

Figure 8:
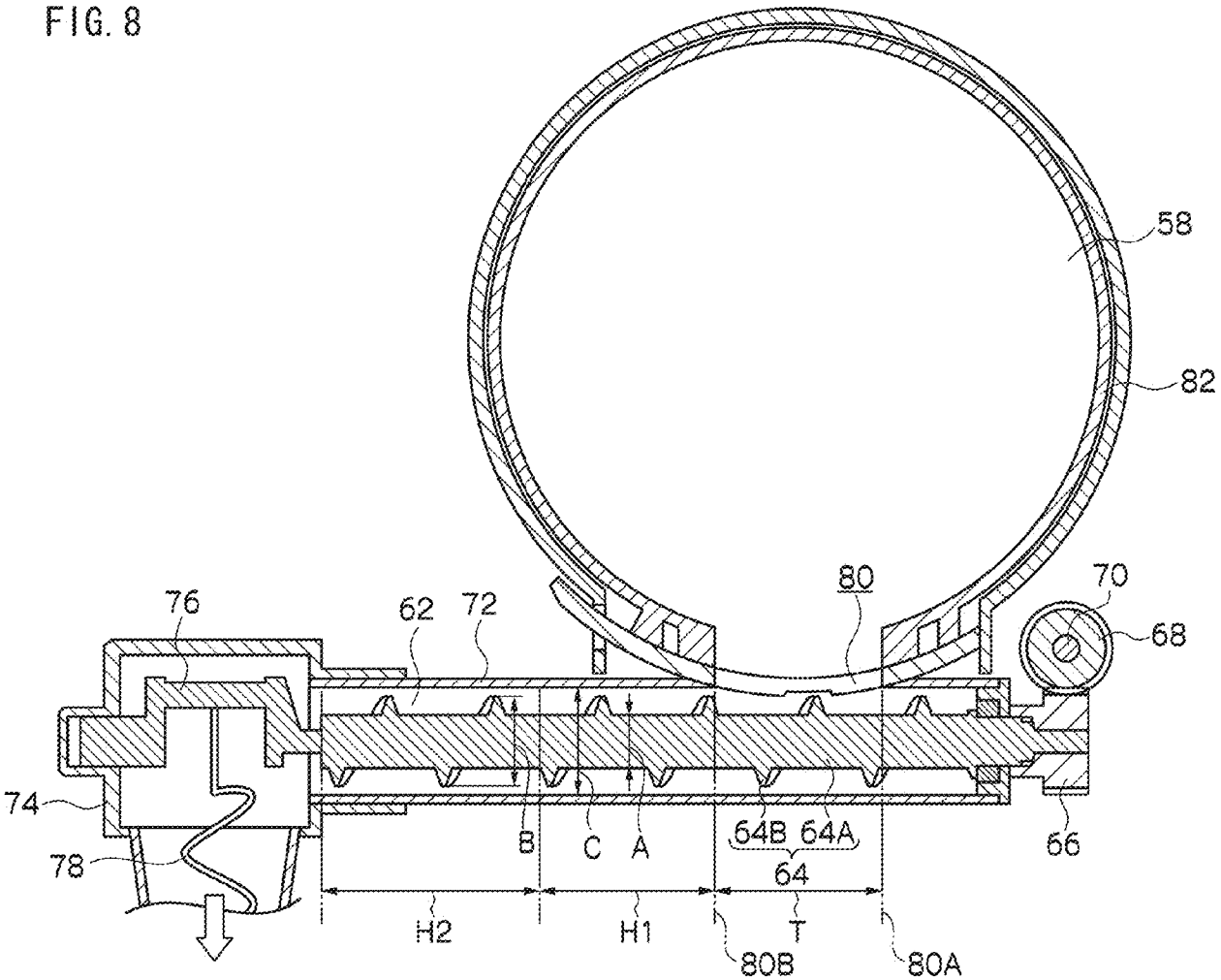
FIG. 8 is a schematic diagram illustrating a configuration of a toner conveying device according to Comparative Example 2.

For Comparative Example 2, in the intake region T, the first conveying region H1, and the second conveying region H2, the inner diameter of the conveying pipe 72 is set to 14 mm, the outer diameter of the blade member 64B is set to 12 mm, and the diameter of the rotating shaft 64A is set to 9 mm (see FIG. 8).

Figure 9:
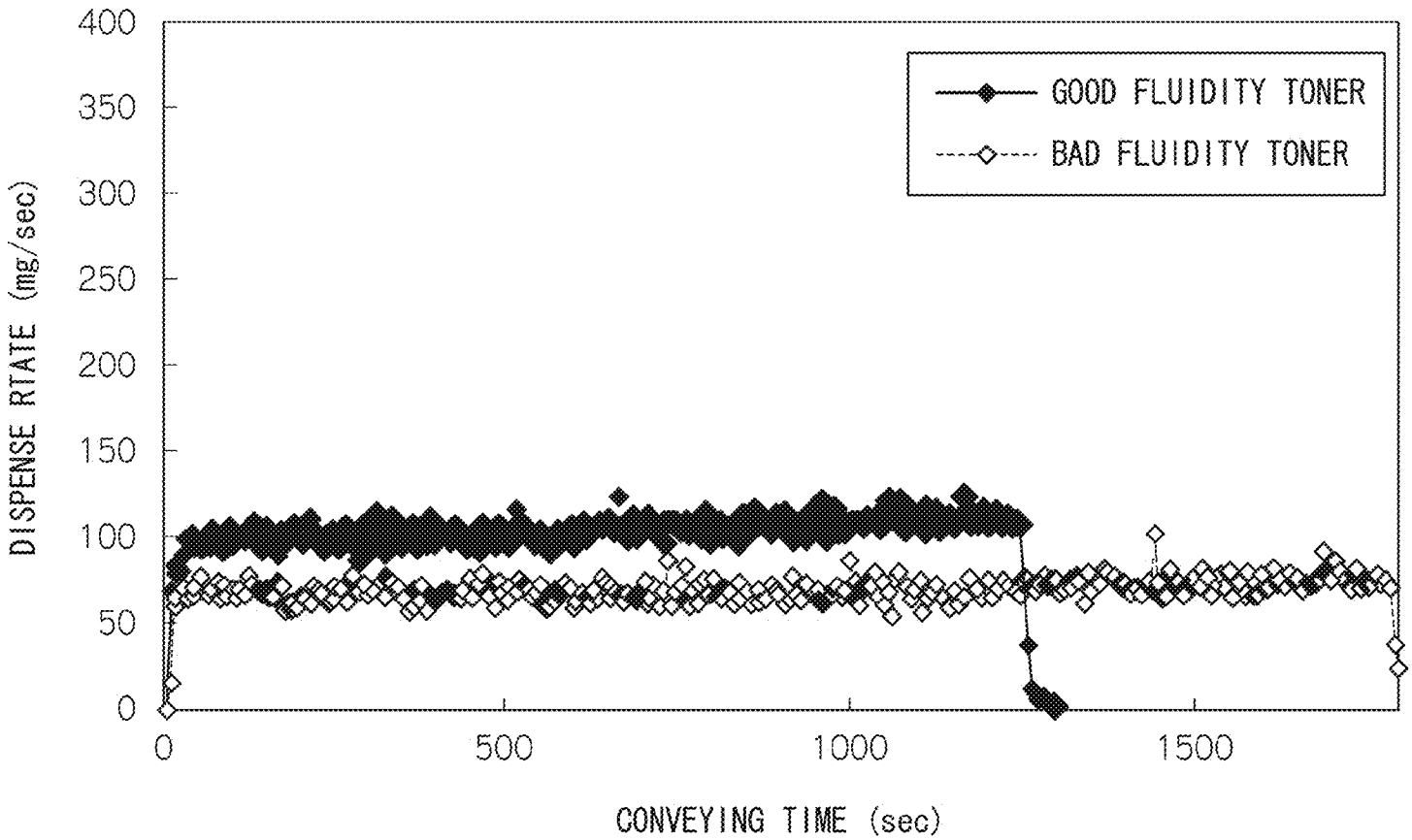
FIG. 9 is a graph illustrating a transition of the dispense rate in Comparative Example 2.

As a result of evaluation of Comparative Example 2, a difference in dispense rate between the toner to which the thermal stress is applied and the toner to which no thermal stress is applied is 33% as illustrated in FIG. 9.

Comparative Example 3

For Comparative Example 3, in the intake region T, the first conveying region H1, and the second conveying region H2, the inner diameter of the conveying pipe 72 is set to 14 mm and the outer diameter of the blade member 64B is set to 12 mm.

Figure 10:
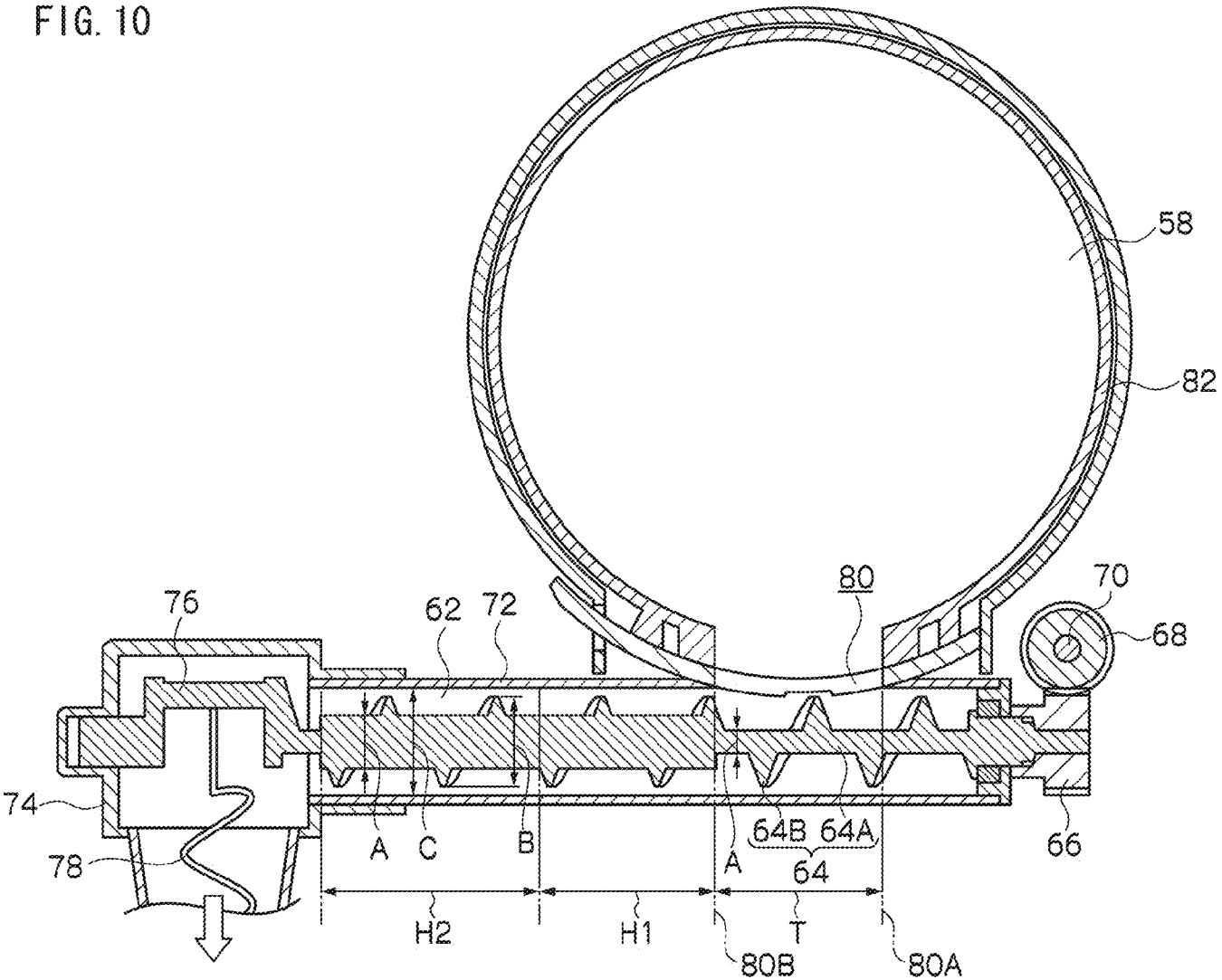
FIG. 10 is a schematic diagram illustrating a configuration of a toner conveying device according to Comparative Example 3.

In the intake region T, the diameter of the rotating shaft 64A is set to 3 mm. In the first conveying region H1 and the second conveying region H2, the diameter of the rotating shaft 64A is set to 9 mm (see FIG. 10).

Figure 11:
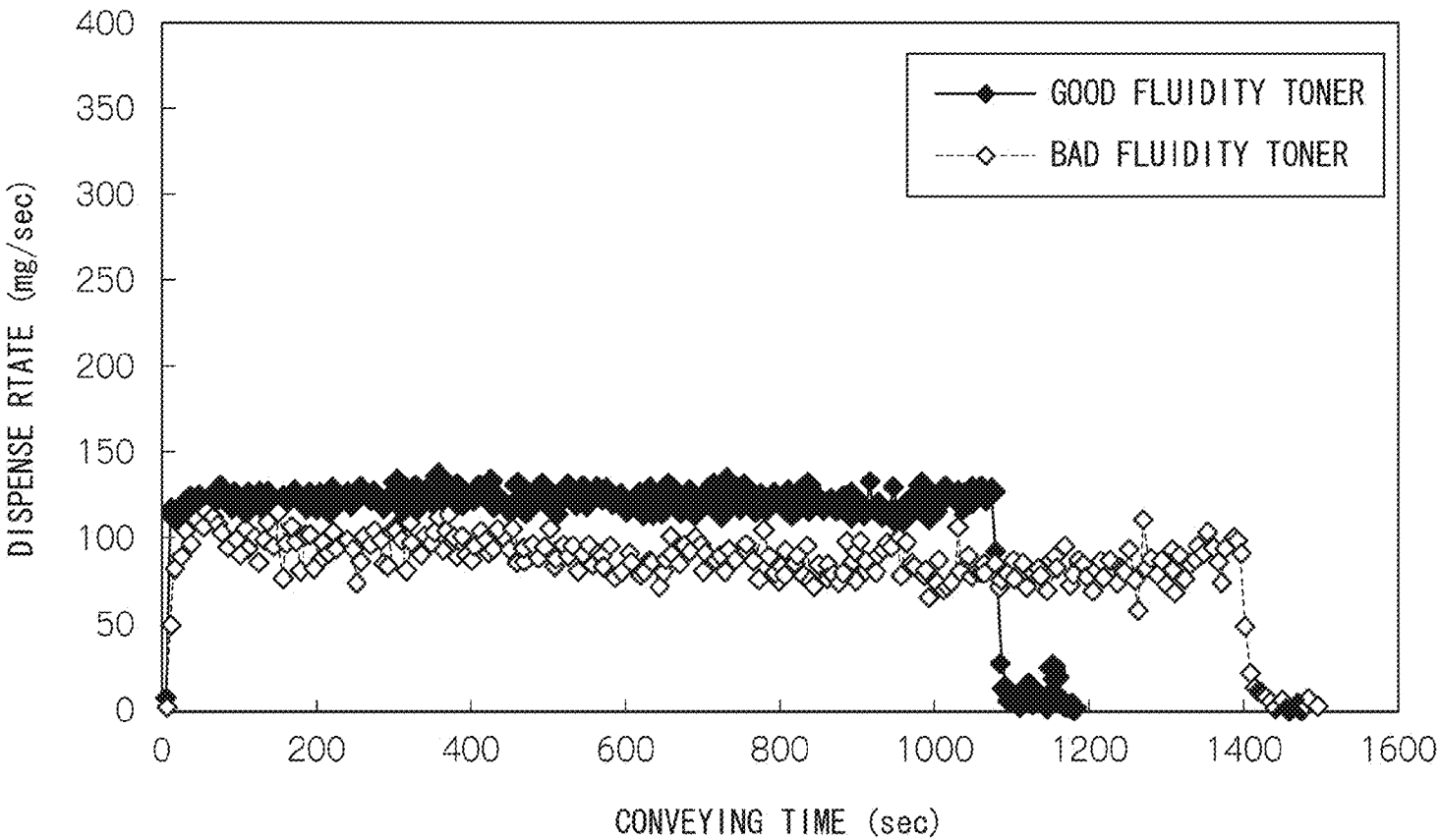
FIG. 11 is a graph illustrating a transition of the dispense rate in Comparative Example 3.

As a result of evaluation of Comparative Example 3, the difference in dispense rate between the toner to which the thermal stress is applied and the toner to which no thermal stress is applied is 27% as illustrated in FIG. 11.

The differences in dispense rate between the toner to which the thermal stress is applied and the toner to which no thermal stress is applied are 25%, 33%, 27% in Comparative Examples 1 to 3. On the other hand, the differences in dispense rate are improved to 3% and 7% in Examples 1 and 2.

In Comparative Example 3, the improvement is not achieved although the conveyable volume per one revolution of the conveying member 64 is made different between in the intake region T and in the first conveying region H1 and the second conveying region H2. That is, it is understood it is important to make different the conveyable volume per one revolution of the conveying member 64 between in the first conveying region H1 and in the second conveying region H2 such as like Examples 1 and 2.

This may be because: although the toner amount taken in between the blade members 64B of the conveying member 64 from the toner accommodating chamber 58 in the intake region T is varied due to the difference in fluidity of the toner, the variation occurred in the intake region T is absorbed therefore stabilize the toner conveying amount by providing "a part where the toner conveyable amount is large" and "a part where the toner conveyable amount is small" in this order in the toner conveying region subsequent to the intake region T.

The invention is not limited to the exemplary embodiment described above, but various modifications, changes, and improvements can be made without departing from the scope of the invention.

What is claimed is:

1. A powder conveying device comprising:

a conveying passage in which powder is conveyed from a first powder accommodating chamber toward a second powder accommodating chamber, the powder being accommodated in the first powder accommodating chamber and the second powder chamber;

a conveying member that is disposed in the conveying passage, and includes a rotating shaft that is rotatable, and a blade member that is spirally provided around the rotating shaft, and can convey the powder by rotation of the rotating shaft;

an intake region that is formed on the conveying passage where the conveying member is disposed, and includes an intake port through which the powder is taken in from the first powder accommodating chamber;

a first conveying region that is formed on the conveying passage where the conveying member is disposed, and is arranged on a downstream side of the intake region in a conveying direction of the powder; and a second conveying region that is formed on the conveying passage where the conveying member is disposed, and is arranged on a downstream side of the first conveying region in the conveying direction, a conveyable volume of the powder per one revolution of the conveying member at the second conveying region being lower than that at the first conveying region, wherein the rotating shaft of the conveying member is extended along the intake region, the first conveying region and the second conveying region.

2. The powder conveying device of claim 1, wherein a diameter of the rotating shaft of the conveying member in the second conveying region is larger than that of the first conveying region.

3. The powder conveying device of claim 2, wherein an outer diameter of the blade member of the conveying member in the second conveying region is smaller than that of the first conveying region.

4. The powder conveying device of claim 2, wherein a width of the conveying passage in the second conveying region is smaller than that of the first conveying region.

5. The powder conveying device of claim 1, wherein an outer diameter of the blade member of the conveying member in the second conveying region is smaller than that of the first conveying region.

6. The powder conveying device of claim 1, wherein a width of the conveying passage in the second conveying region is smaller than that of the first conveying region.

7. The powder conveying device of claim 1, wherein a pitch of the spirally provided blade member in an axis direction of the rotating shaft in the second conveying region is smaller than that in the first conveying region.

8. An image forming apparatus comprising:

a powder conveying device that conveys toner as powder, including:

a conveying passage in which the powder is conveyed from a first powder accommodating chamber toward a second powder accommodating chamber, the powder being accommodated in the first powder accommodating chamber and the second powder chamber;

a conveying member that is disposed in the conveying passage, and includes a rotating shaft that is rotatable, and a blade member that is spirally provided around the rotating shaft, and can convey the powder by rotation of the rotating shaft;

an intake region that is formed on the conveying passage where the conveying member is disposed, and includes an intake port through which the powder is taken in from the first powder accommodating chamber;

a first conveying region that is formed on the conveying passage where the conveying member is disposed, and is arranged on a downstream side of the intake region in a conveying direction of the powder; and a second conveying region that is formed on the conveying passage where the conveying member is disposed, and is arranged on a downstream side of the first conveying region in the conveying direction, a conveyable volume of the powder per one revolution of the conveying member at the second conveying region being lower than that at the first conveying region; a development device that includes a development chamber as the second powder accommodating chamber, the development chamber accommodating developer including the toner conveyed by the powder conveying device; and an image carrier at which an electrostatic latent image formed on a surface of the image carrier is developed by the developer of the development device, wherein the rotating shaft of the conveying member is extended along the intake region, the first conveying region and the second conveying region.

9. The image forming apparatus of claim 8, wherein a diameter of the rotating shaft of the conveying member in the second conveying region is larger than that of the first conveying region.

10. The image forming apparatus of claim 8, wherein an outer diameter of the blade member of the conveying member in the second conveying region is smaller than that of the first conveying region.

11. The image forming apparatus of claim 8, wherein a width of the conveying passage in the second conveying region is smaller than that of the first conveying region.

12. The image forming apparatus of claim 8, wherein a pitch of the spirally provided blade member in an axis direction of the rotating shaft in the second conveying region is smaller than that in the first conveying region.

* * * * *